US008186417B2

(12) United States Patent
Ribeiro

(10) Patent No.: US 8,186,417 B2
(45) Date of Patent: May 29, 2012

(54) SAVING ENERGY AND OPTIMIZING YIELD IN METAL CASTING USING GRAVITY AND SPEED-CONTROLLED CENTRIFUGAL FEED SYSTEM

(75) Inventor: Vagner Ribeiro, Saline, MI (US)

(73) Assignee: Gravcentri, LLC, Springfield, OH (US)

( * ) Notice: Subject to any disclaimer, the term of this patent is extended or adjusted under 35 U.S.C. 154(b) by 41 days.

(21) Appl. No.: 12/507,129

(22) Filed: Jul. 22, 2009

(65) Prior Publication Data

US 2010/0078144 A1 Apr. 1, 2010

Related U.S. Application Data

(60) Provisional application No. 61/101,405, filed on Sep. 30, 2008.

(51) Int. Cl.
*B22D 13/00* (2006.01)
*B22D 13/12* (2006.01)

(52) U.S. Cl. ..... 164/114; 164/115; 164/116; 164/286; 164/289

(58) Field of Classification Search ..... 164/114, 164/115, 116, 286, 289
See application file for complete search history.

(56) References Cited

U.S. PATENT DOCUMENTS

| | | | | |
|---|---|---|---|---|
| 2,499,387 | A * | 3/1950 | Johnston | 164/176 |
| 4,572,278 | A * | 2/1986 | Sundberg | 164/457 |
| 5,976,445 | A * | 11/1999 | Kuroda et al. | 264/297.4 |
| 6,634,413 | B2 * | 10/2003 | Ray et al. | 164/114 |
| 2004/0040690 | A1 * | 3/2004 | Ray et al. | 164/529 |
| 2004/0060685 | A1 * | 4/2004 | Ray et al. | 164/114 |
| 2008/0023172 | A1 * | 1/2008 | Waugh | 164/114 |

* cited by examiner

*Primary Examiner* — Jessica L Ward
*Assistant Examiner* — Devang R Patel
(74) *Attorney, Agent, or Firm* — Harness, Dickey & Pierce, PLC

(57) ABSTRACT

Molten metal is introduced into the cavity by a combined gravity feed and centrifugal force feed using a rotating turntable under electrical or electronic control. The centrifugal force is controlled to be substantially constant until the metal has solidified. This is accomplished by controlling the ramp-up acceleration of the turntable where rotational velocity is a time-dependent function of rotational radius and molten metal mass and taking into account the flow rate and cooling rate of the liquid metal. The process reduces waste and the attendant energy consumption associated with the quantity of metal required to be melted for the initial pour and associated with reprocessing and reusing the waste component.

9 Claims, 6 Drawing Sheets axis of rotation gravity dominant
20
s
$m_g$ acceleration
20
α
s
$m_1$
$r_1$ acceleration
20
s
$m_2$
$r_2$ acceleration
20
s
$m_3$
$r_3$ coast
20
$m_4$
$v(t) = \sqrt{\frac{G_c\, r(t)}{m(t)}}$

SAVING ENERGY AND OPTIMIZING YIELD IN METAL CASTING USING GRAVITY AND SPEED-CONTROLLED CENTRIFUGAL FEED SYSTEM

CROSS-REFERENCE TO RELATED APPLICATIONS

This application claims the benefit of U.S. Provisional Application No. 61/101,405, entitled "Gravicentri—Gravity-Centrifugal combined process to produce metal castings," filed on Sep. 30, 2008. The entire disclosure of the above application is incorporated herein by reference.

BACKGROUND AND SUMMARY

The present disclosure relates generally to metal casting and, more particularly, to improvements in casting through gravity and centrifugal force feed through an ingate system.

In conventional sand casting, a cast part is produced by first creating a mold from a sand mixture and then pouring molten liquid metal into the cavity of the mold through an ingate system having an inlet disposed above the top of the mold so that the liquid metal flows under the force of gravity into the cavity through a passageway or sprue and runner. The mold is then allowed to cool until the casting solidifies, and the casting is then separated from the mold. The sand that is reclaimed for reuse. To allow for overall shrinkage as the part cools, the sand mold cavity is made slightly larger than the finished part.

Conventional sand casting poses several problems. When molten metal is introduced through the gating system, air will sometimes become trapped within recesses of the cavity as the level of molten metal rises. When air becomes trapped in this fashion, the finished casting will solidify with a defect, requiring it to be discarded as waste. Thus, great care is given when designing mold configurations and often special vents are provided in the hard-to-reach places, so that air will not become trapped. To ensure that the entire cavity becomes filled, the mold configuration will typically include an extra reservoir or riser at the inlet that contains extra molten metal. The riser allows the foundry operator to pour more metal than is needed to define the finished part. This extra metal provides a head of pressure that forces extant gasses through the vents and/or permeable surface of the mold and ensures that the entire cavity is fully filled before solidifying takes place.

Of course, as molten metal is poured into this system, it will ultimately solidify in the sprue, runner, ingates, risers and vents as well. Thus, when the finished part is removed, the excess material that has solidified in the sprue, runner, ingates, risers and vents will need to be cut away and discarded as waste. In conventional practice this removal is performed mechanically, using abrading tools, compressors and the like. Thus a significant amount of electrical energy is consumed in the conventional removal process. Thereafter, the waste material will be melted again for reuse, which consumes significant additional energy.

The modern metal casting foundry, like most other manufacturing businesses, faces considerable pressure to reduce costs, reduce waste, and reduce energy consumption. In this regard, it would be desirable to reduce energy consumption my minimizing the amount of metal needed to be melted for the initial pour; and to further eliminate the waste associated with removal and re-melting of waste for reuse. Given the practical limitations of conventional sand casting, it has not been heretofore been possible to produce casting where the quantity of liquid metal poured in to the mold is sufficient to supply the finished part but constitutes very little additional waste.

The present invention significantly improves energy efficiency, reduces waste, and minimizes the need for risers and vents through a process that uses both gravity feed and centrifugal force feed to very accurately control the flow of molten metal into the mold cavity and thereby minimize the amount of metal remaining in the sprue when the metal cools. If a riser is required, it can be of minimal size thereby minimizing waste. By way of example, a conventional sand casting process will yield approximately 65 pounds of finished product for every 100 pounds of metal poured (65% efficient). The illustrated embodiments described herein will yield approximately 85 pounds of finished product for every 100 pounds of metal poured (85% efficient).

The process uses a rotating table or other rotating apparatus to place the incoming molten metal under a controlled, substantially constant centrifugal force by controlling the ramp-up acceleration and/or velocity of the turntable. Because the molten metal is introduced under very controlled conditions, it is possible to fill most mold cavities without creating air pockets that would other necessitate a vent. The controlled influx technique allows the mold cavity to be filled (1) at a rate that does not damage or degrade the sand mold walls, (2) at a rate that ensures the entire cavity is filled before the metal starts to solidify, and (3) in a controlled quantity that leaves very little excess material that will need to be removed as waste. The controlled influx technique advantageously places the hot spot of the cooling metal at the ingate so that any product shrinkage that occurs when the metal finally solidifies, will occur at the ingate and thus in the sprue and/or riser to be removed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
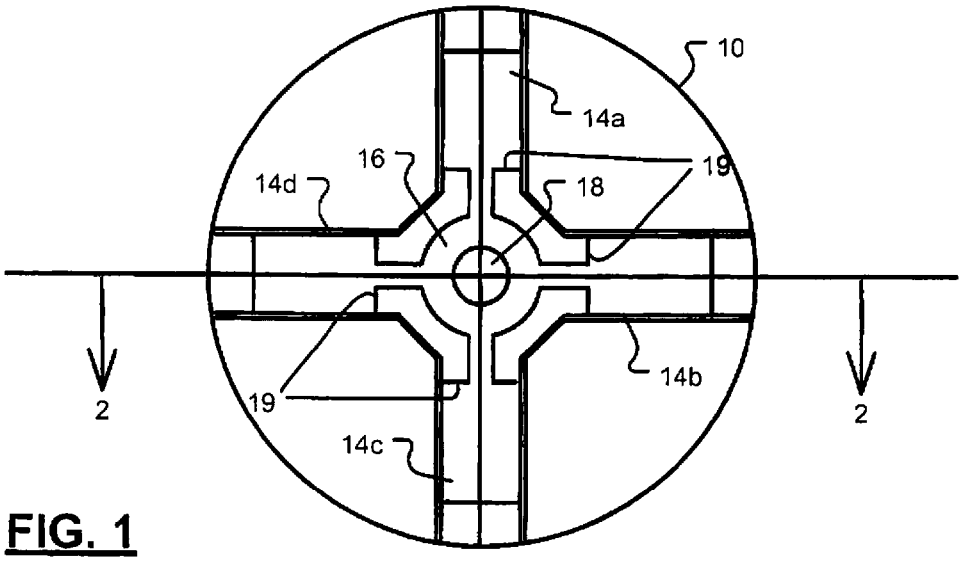
FIG. 1 is a plan view of a turntable in accordance with one preferred embodiment.
Figure 2:
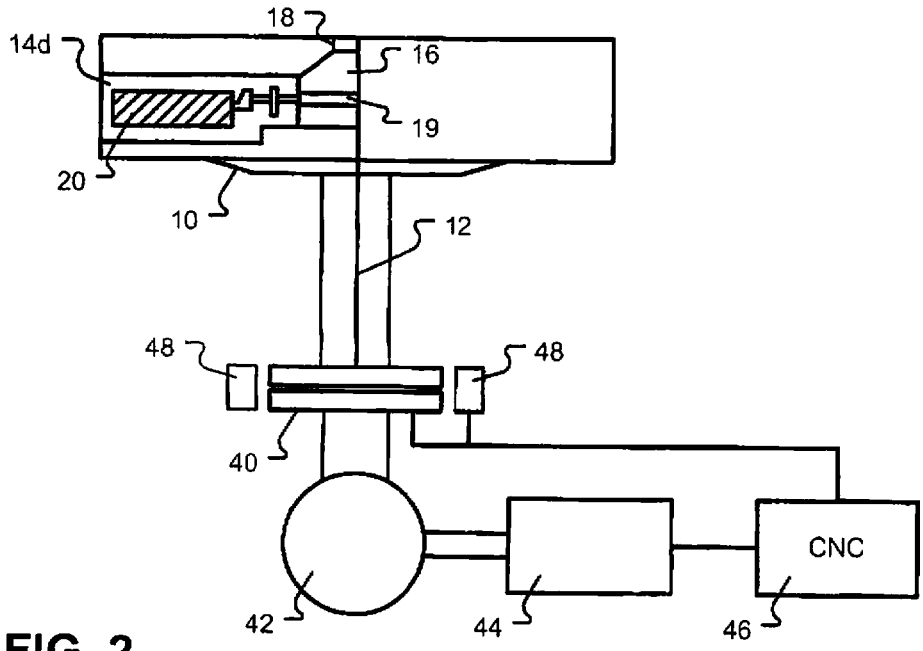
FIG. 2 is a cross-sectional view of the turntable taken substantially along the lines 2-2 of FIG. 1.

Although the apparatus for producing centrifugal force can take many forms, in one presently preferred embodiment, a turntable 10 serves as a vehicle for supporting and rotating one or a plurality of sand molds about a rotation axis 12, as illustrated in FIGS. 1 and 2. In the exemplary embodiment illustrated, the turntable 10 supports 4 sand mold structures 14*a*-14*d* at the 12 o'clock, 3 o'clock, 6 o'clock and 9 o'clock positions. Of course, a greater or smaller number of molds can be implemented based on the needs of the particular application. At the center of turntable 10 is the ingate structure having a pouring basin 16 that defines an inlet 18 through which the molten metal is poured. Molten metal poured into inlet 18 flows downwardly under force of gravity and then laterally through passageways 19 to each of the respective mold structures. As will be more fully explained, the molten metal is introduced into inlet 18 while the turntable is gradually ramped up in speed, causing the molten metal to flow in a controlled fashion into the mold cavity 20 by combined gravity feed and centrifugal force feed.

Figure 3:
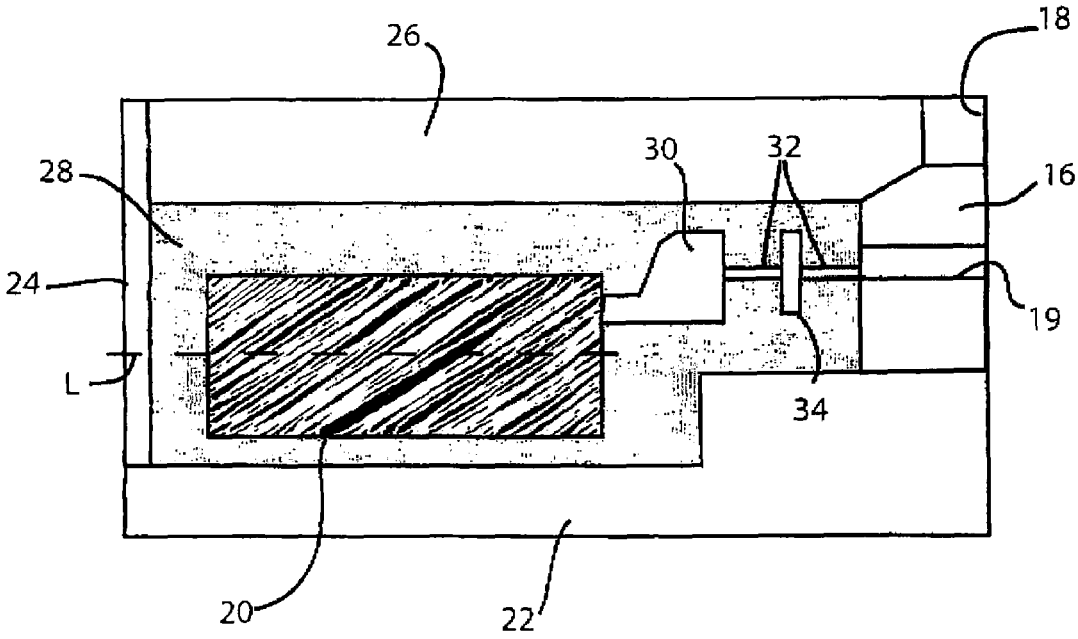
FIG. 3 is a detailed cross-sectional view of the mold cavity and in gate system of the embodiment illustrated in FIGS. 1 and 2.

Referring to FIG. 3, further details of the mold structure and ingate system may be seen. A steel base 22, steel side wall 24 and steel lid 26 define the casting flask that house the sand mold 28. A riser 30 and sprue 32 couple the passageways 19 of pouring basin 16 with the mold cavity 20 so that molten metal introduced into orifice 18 will flow initially by gravity feed through the sprue 32, into the riser 30 and then finally into the cavity 20. If desired, a filter 34 may be introduced in the flow path to filter out impurities. Note that the sprue and riser system are preferably located generally about the center line L of the mold. Thus, the in pour of molten metal will initially flow by gravity feed into the mold cavity.

As best seen in FIG. 2, the turntable 10 is attached via a clutch mechanism or coupling 40 and gearbox 42 to an electric motor 44. The motor is controlled by a suitable electronic controller 46 that allows the ramp-up acceleration and/or speed of the motor to be adjusted as will be next described. The clutch mechanism or coupling 40 can be disengaged to allow the turntable to coast to a stop under its own inertia. If desired, a brake 48 may be included to assist in slowing or stopping rotation of the turntable at the appropriate point in the operating cycle.

Referring now to FIGS. 4*a*-4*e*, a further explanation of the manner of filling the mold cavity under combined gravity feed and centrifugal force feed will now be provided. FIGS. 4*a*-4*e* show successive stages of filling mold cavity 20 as the turntable progressively ramps up and then coasts down in angular speed.

Figures 4A, 4B, 4C, 4D, 4E:
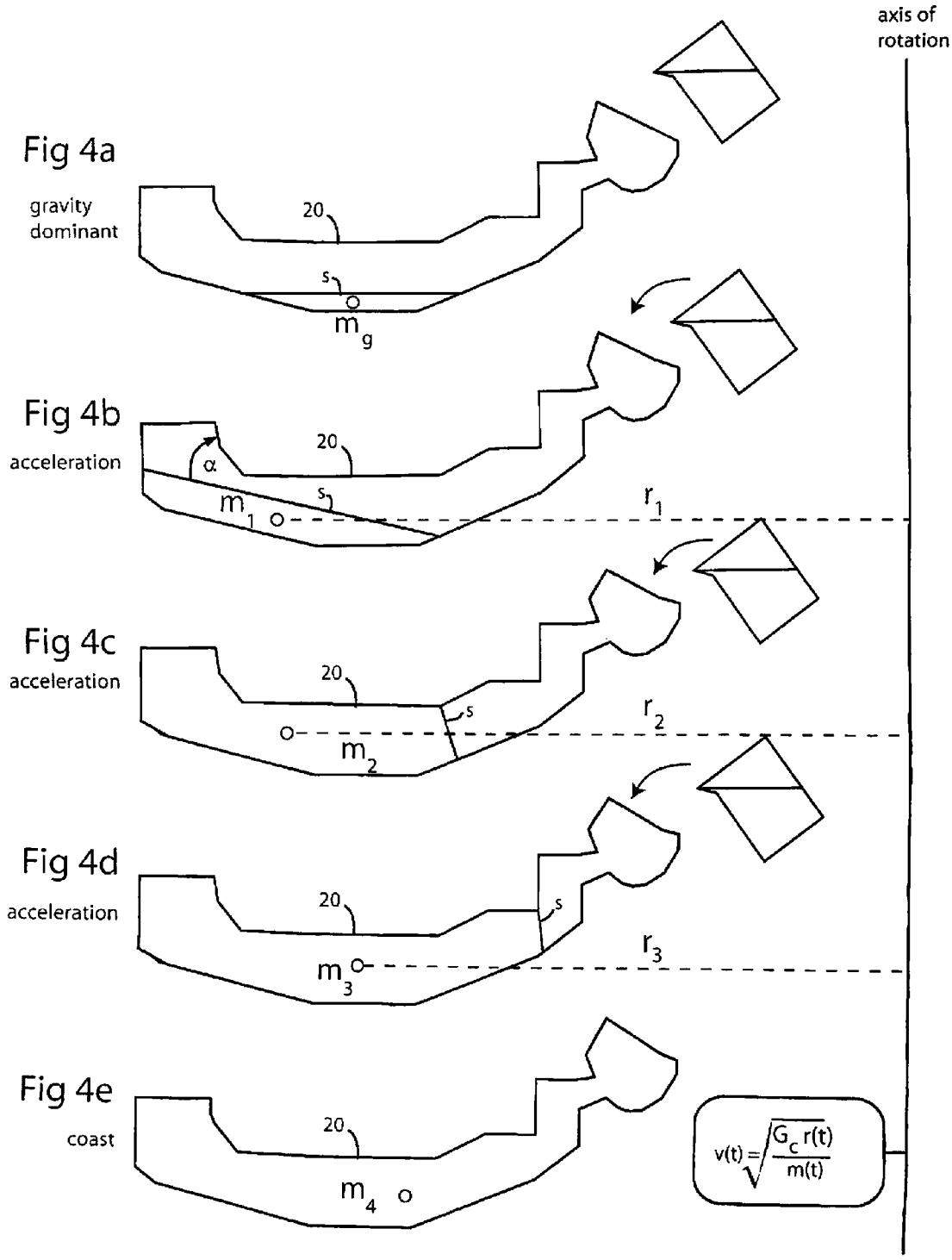
FIG. 4 is a series of cross-sectional views of an exemplary mold cavity, illustrating how molten metal is introduced into the cavity in accordance with the invention.

As illustrated at FIG. 4*a*, during the initial phase of the pour, the turntable may be stationary or it may be rotating slowly, such that gravity is the dominant force causing the poured metal to flow into the cavity as illustrated. FIGS. 4*b*, 4*c* and 4*d* illustrate that the turntable is accelerated while additional molten metal is introduced into the cavity. Note that the effects of centrifugal force are apparent at these stages of pour. This is evident because the surface of the molten metal "s" becomes increasingly tilted as the acceleration continues, until the surface lies in a substantially vertical plane, as illustrated in FIG. 4*d*. Once the entire quantity of liquid metal has been introduced into the mold cavity, the driving force applied to the turntable is removed, allowing the turntable to gradually coast to a stop. During this coasting time, the metal will begin to solidify. Once solidified, the turntable can be permitted to coast to a stop, or the mechanical brake may be used to assist in stopping rotation.

With reference to FIG. 4*b*, note that the relative angle "α" between the surface "s" of the liquid metal and the vertical-most face of the interior cavity of the mold is greater than 0 degrees in FIG. 4*b*. Thus, if the centrifugal force acting on the poured liquid metal were to remain constant throughout the pour, the incline of the surface "s" would remain the same and an air bubble might become trapped in the outer extremity of the part. The ingate filling technique overcomes this by further accelerated the turntable, as illustrated in FIGS. 4*c* and 4*d*, so that the centrifugal force causes the angle of the poured metal surface to equal or exceed the angle of the vertical-most interior surface encountered as the liquid level rises. Thus, by the time the liquid metal pour has reached that shown in FIG. 4*d*, the angle "α" is essentially 0, and any trapped gas will be purged.

The amount of centrifugal force required to purge trapped gas will, of course, depend on the geometry of the part being manufactured, that is it will depend on the interior geometry and construction of the mold cavity. Where the mold cavity is made of gas permeable material, trapped gas can be relieved through the permeable sidewalls of the cavity. In other embodiments where the mold cavity is impermeable, more care may need to be taken to ensure any trapped gas is purged.

In the exemplary embodiment illustrated in FIGS. 4*a*-4*e*, a centrifugal force on the order of 5g (5 times the force of gravity) achieves the desired result. A greater centrifugal force could be used, of course, but at some point degradation of the sand mold can occur. Thus, the preferred technique is to maintain a substantially constant centrifugal force during all but the initial stages of the pour, where the constant centrifugal force is (a) sufficient to tilt the surface of the molten metal sufficiently to fill any voids in the cavity, and (b) safely below the point at which mold degradation may occur.

Figure 5:
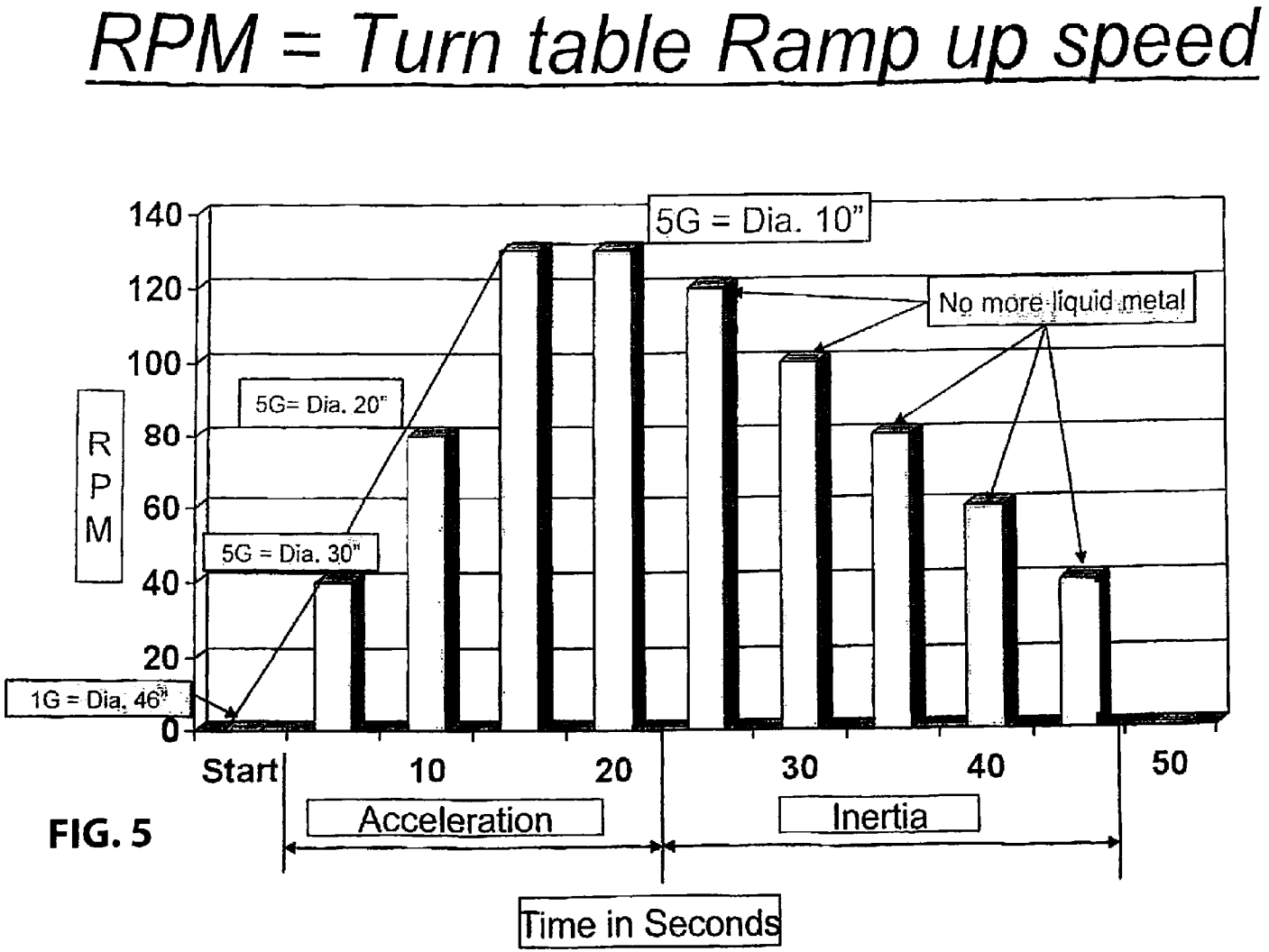
FIG. 5 is a graph depicting ramp-up and coast phases of turntable operation.

FIG. 5 is a graph depicting an exemplary ramp-up in the turntable speed during the pouring phase, followed by a coasting phase after the liquid metal has solidified. As illustrated in the graph and also as reflected in the equation below, the velocity of the turntable changes during the pour, in order to maintain a substantially constant centrifugal force ($G_c$). The velocity varies with time based on several factors.

$$v(t)\sqrt{\frac{G_c r(t)}{m(t)}} \qquad \text{Eq 1}$$

As Eq. 1 above illustrates, the rotational velocity of the turntable is proportional to the square root of the radius of rotation/metal mass ratio. In the equation, a constant centrifugal force $G_c$ is selected to lie within a range (a) sufficient to tilt the surface level of the molten metal so that air pockets are eliminated and (b) a high force that would damage or degrade the sand mold. Although the rotational velocity $V_t$ is influenced by the centrifugal force $G_c$, that velocity is not constant because both the radius of rotation r(t) and mass of the poured metal m(t) change as the pour progresses.

To see this, refer to FIGS. 4*a*-4*e*. It will be seen that the radius of rotation (r), measured from the axis of rotation of the turntable to the center of gravity of the liquid metal, changes as the level of molten metal rises. In general, the radius of rotation becomes shorter as the cavity becomes filled. Similarly, the mass of the molten metal contained within the cavity increases as the cavity becomes filled. Thus, the rotational radius/mass ratio is time-dependent. Hence, the rotational velocity of the turntable must be controlled to reflect this time dependency. In one preferred embodiment, the controller 46 drives the motor 44 based on this relationship to achieve the desired ramp-up and coast behavior.

The controlled velocity of the turntable is a function of time, and in this case time is a function of still further variables, namely the flow rate at which molten metal is introduced and the rate at which the molten metal solidifies.

As illustrated in FIG. 3, molten metal is introduced through a sprue 32 with embedded filter 34. This inlet structure acts as a restricted orifice that controls the rate at which liquid metal flows into the riser, and the riser also may include a restricted region through which metal flows into the cavity. Depending on the geometries of the cavity being filled and upon the respective diameters of these restricted orifices, the liquid metal will flow into the cavity at a controlled rate. Thus, given the final volume of the cavity, and this flow rate, the amount of time needed to fill the cavity and the requisite centrifugal force can be determined.

As depicted in the graph in FIG. 5, the velocity of the turntable is ramped up over this filling interval where the acceleration or ramp-up rate is controlled to achieve a substantially constant centrifugal force in spite of the fact that the rotational radius and mass of the liquid metal are changing. After the cavity becomes filled, a centrifugal force greater than that of gravity is continued to be applied until the metal solidifies. This may be accomplished by maintaining the rotational rate of the turntable at the rate achieved when the cavity became completely filled. By maintaining the centrifugal force at this level, the liquid metal is forced to remain in the cavity until it cools. In this way, it is possible to precisely fill the cavity without relying on a large quantity of excess metal in the riser to present defects in the finished part.

Once the cavity has been entirely filled, and once the metal begins to solidify, it is possible to remove the driving force from the turntable, allowing it to coast to a stop on its own inertia. The driving force may be removed at a point where the liquid metal will have finally cooled before the turntable coasts to a speed below which molten metal could bleed out of the cavity.

By judiciously choosing the point at which the driving force to the turntable is removed, the combined gravity and centrifugal force feed technique saves a significant amount of energy and maximizes the speed at which cast parts can be manufactured. The driving force shut-off point is largely controlled by the rate at which the liquid metal solidifies.

Figure 6:
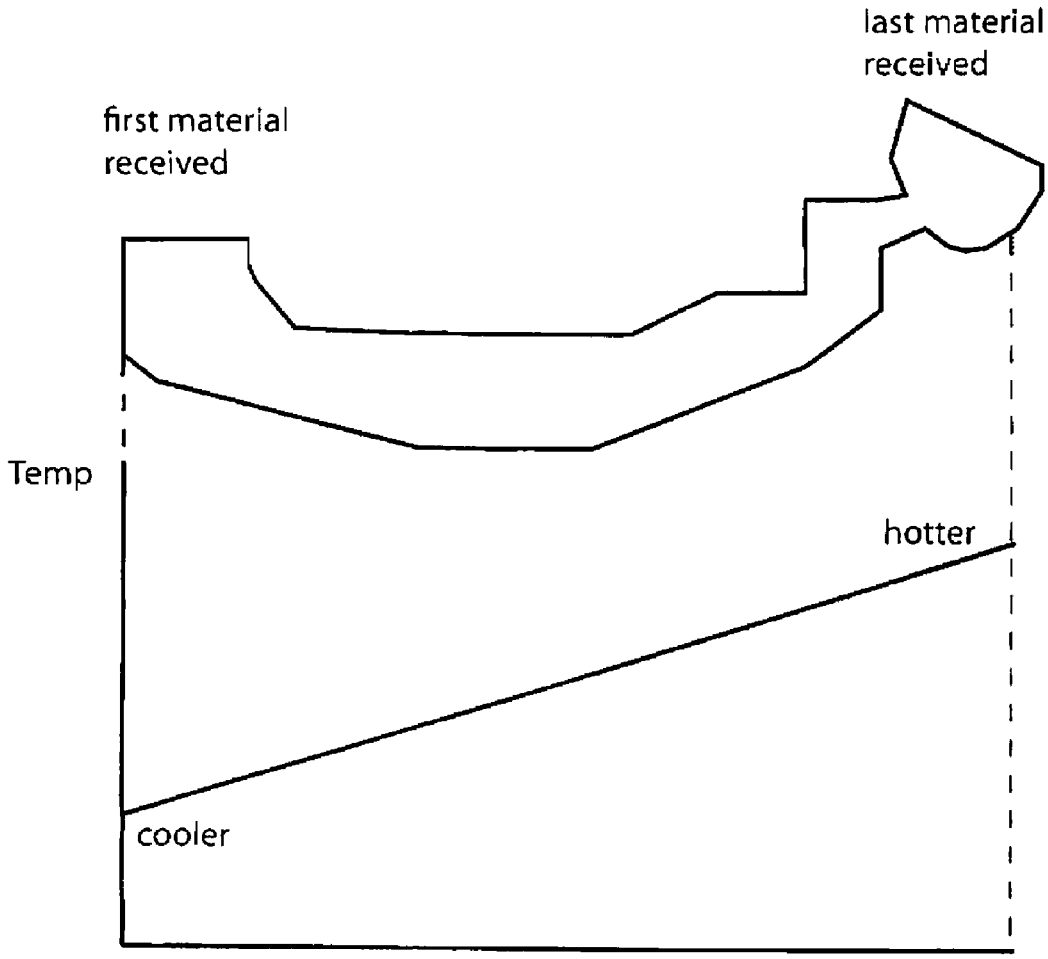
FIG. 6 is a thermal diagram of the exemplary cavity of FIG. 4, illustrating how the molten metal cools in relation to the geometry of the part.

As illustrated in FIG. 6, the first material received in the cavity (at the end furthest from the sprue) becomes to cool sooner and is thus at a cooler temperature than the last material received (at the sprue end). Thus, at some point, material at the cooler end of the cavity will have solidified whereas material at the hotter end will still be in a molten state. Thus, the mass of molten metal within the cavity is gradually reduced to 0 as the part solidifies further.

Because the centrifugal force is used to hold the molten metal in the cavity, the mass value in Equation 1 gradually falls to 0 as the part solidifies. Thus, the velocity requirements of the turntable may need to account for this effect to achieve ultimate control over the formation of the finished part with minimal waste. In this regard, while it is the goal to eliminate all waste material, in practice, there is usually a final small shrinkage defect at the point where the metal is last to cool. Thus, it may be necessary to pour slightly more material than is required so that the final shrinkage defect occurs in the riser region which can be cut away and re-melted. Because the size of the waste material is small, it is often possible to break away the waste portion by hand (without the need to use grinding equipment and other energy-consuming power tools).

The gravity and speed-controlled centrifugal feed system can be implemented in a variety of different configurations. The turntable, for example could be replaced by a hub and spoke spider wheel in which the mold flasks are disposed on the spokes of the wheel. Alternatively, the turntable might be replaced with a rotating drum, where the mold flasks are placed about the inner side wall of the drum.

Figure 7:
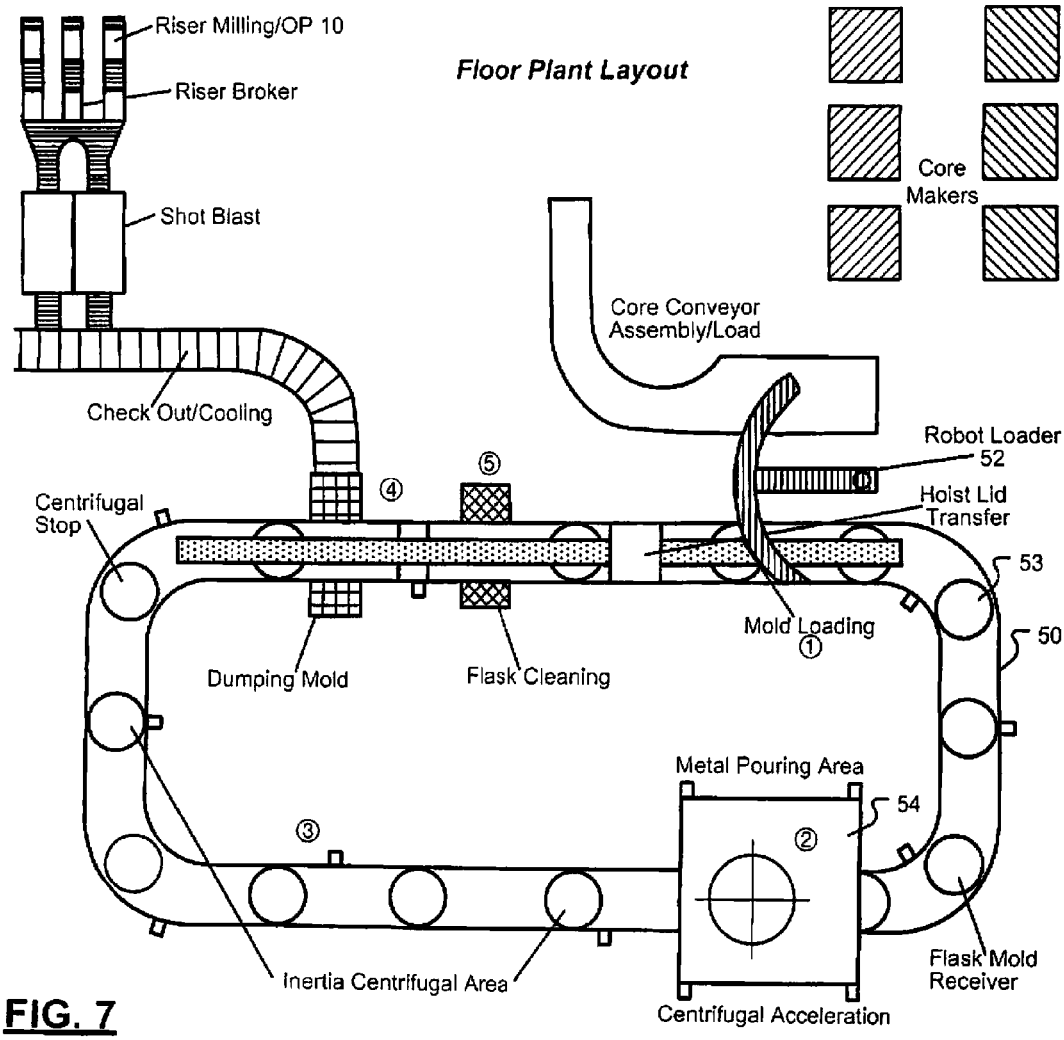
FIG. 7 is a plan view of an exemplary plant layout that incorporates the gravity and speed-controlled centrifugal feed system.

The feed system technique described herein lends itself well to economical, space-saving and energy-efficient plant floor layouts. Exemplary of such is the layout shown in FIG. 7. As illustrated there, a conveyor system 50 delivers the mold flasks to various operating stations. Thus at location $\hat{1}$, a robot loader 52 lifts the flasks containing the sand mold assembly onto the conveyor where it is then transported at $\hat{2}$ to the metal pouring area 54. The mold flasks are placed on turntable structures 53 that each has a drive coupling assembly on the underside. This coupling assembly mates with the electrically driven motor that applies the rotational velocity to that turntable when it is in the metal pouring area 54. The ramp-up acceleration of the turntable is controlled as discussed above as metal is poured in a controlled amount into the in gate.

Once the cavities have been filled and the metal has sufficiently cooled, the conveyor transports the turntable to the inertia centrifugal area $\hat{3}$ where the turntable coasts under its own inertia to a final stop. The conveyor 50 is designed so that the final stop occurs near the mold dumping station $\hat{4}$. At this station, the finished part is removed from the mold and treated conventionally to shot blast the surface and remove the riser. The flask then conveys onto the flask cleaning station $\hat{5}$ where it is ready for reuse at step $\hat{1}$.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method for casting metal comprising:

providing an elongated sand mold cavity having an orifice through which molten metal may be introduced;

disposing said mold on a rotatable structure having a rotational axis that defines a plane of rotation, and such that the center of the mold cavity is spaced apart from the rotational axis;

pouring molten metal into said orifice at a rate that ensures the entire cavity is filled before the metal starts to solidify while at the same time causing said turntable to increase in rotational state, thereby producing a centrifugal force tending to cause the molten metal to flow in a radially outward direction with respect to the rotational axis of the turntable such that the upper surface of the molten metal under the combined influence of centrifugal force and gravity defines an angle with respect to the plane of rotation;

varying the rotation velocity of the turntable during the pouring of molten liquid metal into said orifice to maintain the molten metal introduced into said mold cavity under a substantially constant centrifugal force as molten metal is added so that the centrifugal force causes an angle of a poured liquid metal surface to equal or exceed an angle of a vertical-most interior surface encountered as the poured liquid metal level rises, wherein the vertical-most interior surface is located farthest from said orifice and is substantially perpendicular to a bottom surface of said mold cavity; and continuing to rotate said turntable until the molten metal in said cavity solidifies.

2. The method of claim 1 wherein said rotational velocity is varied by controlling ramp-up acceleration of the turntable to maintain substantially constant the centrifugal force upon the molten metal within the mold cavity.

3. The method of claim 1 wherein said rotational velocity is varied in proportion to the rate at which molten metal is poured into said orifice.

4. The method of claim 1 wherein said rotational velocity is varied by taking into account the change in distance from the rotational axis of the center of gravity of the molten metal within said cavity as the molten metal is poured.

5. The method of claim 1 wherein said rotational velocity is varied by taking into account the change in mass of the molten metal within said cavity as the molten metal is poured.

6. The method of claim 1 wherein said substantially constant centrifugal force is determined to produce an angle of incline of the surface of the molten metal that is substantially congruent with the angle of an interior surface of the mold cavity.

7. The method of claim 1 wherein said substantially constant centrifugal force is determined to be lower than the force at which damage to the mold occurs.

8. A method for casting metal comprising:

providing an elongated sand mold cavity having an orifice through which molten metal may be introduced;

disposing said mold on a rotatable structure having a rotational axis that defines a plane of rotation, and such that the center of the mold cavity is spaced apart from the rotational axis;

pouring molten metal into said orifice at a rate that ensures the entire cavity is filled before the metal starts to solidify while at the same time causing said turntable to increase in rotational state, thereby producing a centrifugal force tending to cause the molten metal to flow in a radially outward direction with respect to the rotational axis of the turntable such that the upper surface of the molten metal under the combined influence of centrifugal force and gravity defines an angle with respect to the plane of rotation;

varying the rotation velocity of the turntable during the pouring of molten liquid metal into said orifice to maintain the molten metal introduced into said mold cavity under a substantially controlled centrifugal force as molten metal is added so that the centrifugal force causes an angle of a poured liquid metal surface to equal or exceed an angle of a vertical-most interior surface encountered as the poured liquid metal level rises, wherein the vertical-most interior surface is located farthest from said orifice and is substantially perpendicular to a bottom surface of said mold cavity; and continuing to rotate said turntable until the molten metal in said cavity solidifies.

9. A method for casting metal comprising:

providing an elongated sand mold cavity having an orifice through which molten metal may be introduced;

disposing said mold on a rotatable structure having a rotational axis that defines a plane of rotation, and such that the center of the mold cavity is spaced apart from the rotational axis;

pouring molten metal into said orifice at a rate that ensures the entire cavity is filled before the metal starts to solidify while at the same time causing said turntable to increase in rotational state, thereby producing a centrifugal force tending to cause the molten metal to flow in a radially outward direction with respect to the rotational axis of the turntable such that the upper surface of the molten metal under the combined influence of centrifugal force and gravity defines an angle with respect to the plane of rotation;

varying the rotation velocity of the turntable during the pouring of molten liquid metal into said orifice to maintain the molten metal introduced into said mold cavity under a substantially controlled centrifugal force on the molten metal as molten metal is added so that the centrifugal force causes an angle of a poured liquid metal surface to equal or exceed an angle of a vertical-most interior surface encountered as the poured liquid metal level rises, where the centrifugal force is controlled to be within the range between: (a) a force sufficient to substantially purge trapped gasses from within the mold and (b) a force sufficient to cause damage to the mold, wherein the vertical-most interior surface is located farthest from said orifice and is substantially perpendicular to a bottom surface of said mold cavity; and continuing to rotate said turntable until the molten metal in said cavity solidifies.

* * * * *